United States Patent [19]

Born et al.

[11] Patent Number: 5,076,145

[45] Date of Patent: Dec. 31, 1991

[54] AXIAL PISTON PUMP HAVING A BLOCKING VALVE IN A MANUALLY CONTROLLED VALVE PLATE

[75] Inventors: Ellis H. Born, Columbus; David L. Thurston, Ashley, both of Ohio

[73] Assignee: Hagglunds Denison Corporation, Columbus, Ohio

[21] Appl. No.: 532,820

[22] Filed: Jun. 4, 1990

[51] Int. Cl.[5] ..... F01B 3/02

[52] U.S. Cl. ..... 92/12.2; 91/506; 417/222 R

[58] Field of Search ..... 91/505, 506, 420; 92/12.2, 71; 417/222

[56] References Cited

U.S. PATENT DOCUMENTS

| | | | |
|---|---|---|---|
| 2,625,168 | 1/1953 | Charlson | 91/420 |
| 2,778,378 | 1/1957 | Presnell | 91/420 |
| 3,126,706 | 3/1964 | Dettinger | 91/420 |
| 3,129,720 | 4/1964 | Allen et al. | 91/420 |
| 3,272,085 | 9/1966 | Hajma | 91/420 |
| 3,381,624 | 5/1968 | Born | 92/12.2 |
| 3,908,519 | 9/1975 | Born et al. | 92/12.2 |
| 3,908,687 | 9/1975 | Wood | 91/420 |
| 3,967,541 | 7/1976 | Born et al. | 92/12.2 |

*Primary Examiner*—Edward K. Look
*Assistant Examiner*—F. Daniel Lopez
*Attorney, Agent, or Firm*—Thomas S. Baker, Jr.

[57] ABSTRACT

A manual servo control valve for variable displacement axial piston pump incorporating a blocking mechanism which serves to block the inlet and outlet ports of the valve when the valve is not operating to change the displacement of the pump.

1 Claim, 2 Drawing Sheets

FIG. 3
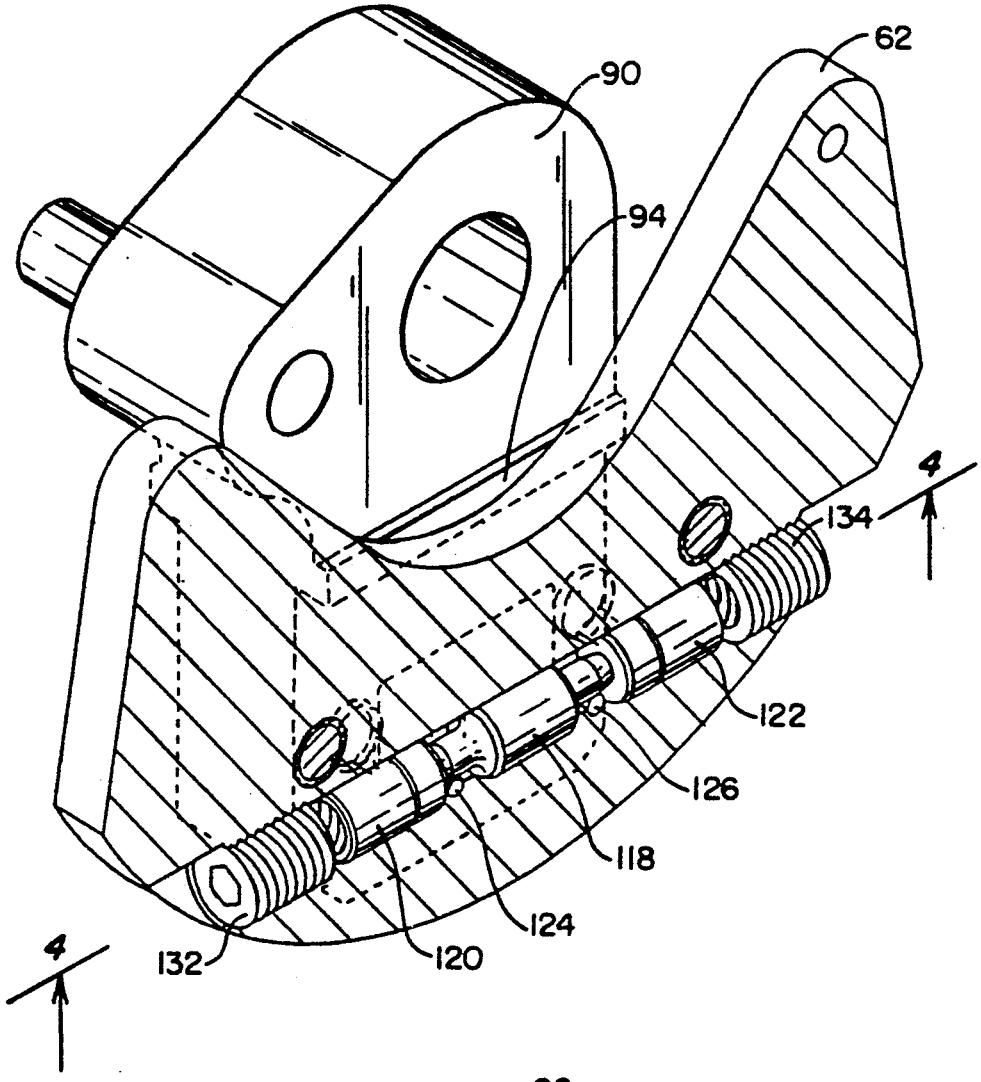
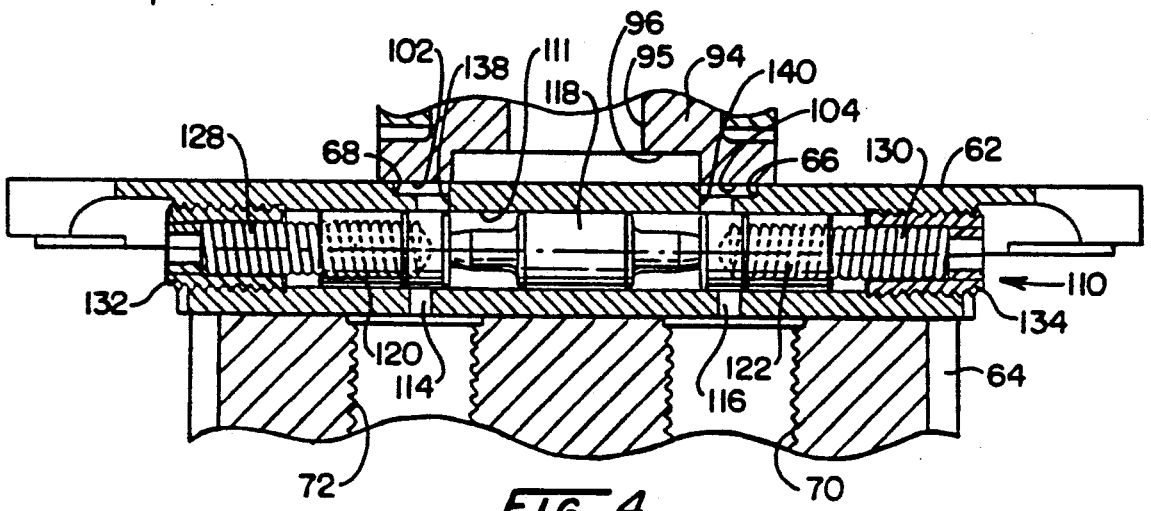
FIG. 4

AXIAL PISTON PUMP HAVING A BLOCKING VALVE IN A MANUALLY CONTROLLED VALVE PLATE

BACKGROUND OF THE INVENTION

A variable displacement axial piston pump having a rocker cam pivotally mounted in a rocker cradle within the housing may employ a fluid motor to change the displacement of the device. In one type of device vanes mounted on each side of the rocker cam project into sealed fluid chambers which cooperate with the vanes to make hydraulic motors. Fluid introduced into chambers defined on one side or the other of the vanes causes the rocker cam to pivot in the rocker cradle to change the displacement of the pump. A manual control for such a device may include a rotating control arm having a shoe which slides on the surface of a valve plate. The valve plate may have a pair of fluid receiving ports connected to fluid passages leading to the fluid receiving chambers on opposite sides of the fluid motor vane. Movement of the control arm in one direction or the other provides fluid to the vane chambers on one side or the other of the vane to cause the rocker cam to pivot to a position set by the control arm. Since the valve plate pivots with the rocker cam the control has an automatic follow-up feature. Such a manual control known in the art as a rotary servo type input control is described in detail in U.S. Pat. No. 3,967,541 assigned to the predecessor in interest of the Assignee of the present invention.

In the aforementioned rotary servo manual input control the fluid must be supplied to one set of vane chambers to bias the vanes in one direction and simultaneously fluid must be exhausted from the vane chambers on the other side of the vane to enable the fluid motors to operate. In fact, when pressure fluid from the shoe in the manual control handle is supplied to one port in the vane plate fluid simultaneously is exhausted from an uncovered fluid port connected to the opposite vane chamber. Thus, it may be seen that the low pressure or tank port for the device is internal to the pump.

The variable displacement axial piston pump described above may have the basic manual rotary servo input control supplemented with an automatic control system which destrokes the pump when fluid pressure or flow exceeds a predetermined set maximum. The same control increases the stroke of the pump when the fluid pressure or flow falls below the amount that has been set by the manual control. Such an automatic control system also assigned to the predecessor in interest of the Assignee of the present invention is described in detail in U.S. Pat. No. 3,908,519.

In the aforementioned manual rotary servo control device, the fluid ports in the valve plate connected to the vane chambers are uncovered when the pump is at a set displacement. Additionally, when the automatic control device operates to destroke the pump because of an excessive flow or pressure control fluid is supplied to the vane chambers through fluid passages other than those utilized by the manual input control. When this occurs pressure fluid flows out of the uncovered ports in the valve plate. Because of this, the fluid ports or passages contain orifices or are sized so as to minimize leakage it is apparent that if the leakage from the ports in the valve plate can be prevented that response of the pump to the automatic compensation system would be increased markedly. Additionally, the fluid passages in the valve plate and valve stem could be enlarged so that the pump would respond faster to the manual control.

Additionally, it has been found necessary to block the ports in the valve plate when the pump displacement is being controlled by an auxiliary device such as an electrically operated control valve which supplies fluid to the vane chambers of the fluid motors to change the displacement of the pump through an auxiliary set of passages and the manual rotary control device is made inoperative. If the ports are not sealed the auxiliary device cannot operate to change the displacement of the pump inasmuch as it utilizes servo fluid having a relatively low pressure to control the pump and the manual control uses the same fluid. An example of a hydraulic circuit where an auxiliary device supplies pressure fluid to fluid motors to change the displacement of a pump may be seen in U.S. Pat. No. 3,381,624 assigned to the predecessor in interest of the Assignee of the present invention.

Accordingly, it is desirable to provide a control for a variable displacement axial piston pump of the rotary servo type in which the fluid ports and passages which are supplied pressure fluid from a manual rotary servo input control to operate fluid motors to change the displacement of the pump are blocked when the rotary servo manual input control is not being operated to change the displacement of the pump.

SUMMARY OF THE INVENTION

The invention provides a manual control for a variable displacement axial piston pump having a rocker cam pivotally mounted within the housing for changing the displacement of the pump. A servo fluid motor pivots the cam between a position of maximum fluid displacement in one direction and a position of maximum displacement in the other direction with a centered position of minimum fluid displacement therebetween. A first fluid member attaches to the rocker cam and a second fluid motor member cooperates with the first fluid motor member to define a fluid motor having first and second sealed fluid receiving chambers. A rotary servo control valve supplies servo pressure fluid to one of the first and second sealed fluid receiving chambers to selectively operate the fluid motor to move the rocker cam to a position set by the control valve. The control valve includes a movable control arm, a flat valve plate having first and second fluid receiving ports secured to and movable with the rocker cam which ports communicate with first and second passage means which connect to the first and second fluid receiving chambers. A valve shoe carried by the control arm has a flat face slideable on the flat valve plate. The valve shoe has a fluid supply port in its face connected to a source of servo pressure fluid and is movable by the control arm between positions overlying one or the other of the first or second fluid receiving ports and a centered position between the first and second fluid receiving ports. A blocking device blocks fluid flow between the first and second fluid receiving chambers and the first and second fluid receiving ports when the valve shoe is in the centered position. The blocking device has a piston bore which intersects the first and second passage means with a shuttle having a sealing land which seals the piston bore slideable in the piston bore. A first piston slideable in the piston bore is positioned on one side of the shuttle and a second piston slideable in the piston bore is positioned on the opposite side of the shuttle. A first stop positions the first piston in the bore such that the piston blocks the first passage means and a second stop positions the second piston in the piston bore such that the second piston blocks the second passage means. A first spring biases the first piston towards first stop and a second spring biases the second piston towards the second stop.

DESCRIPTION OF THE DRAWINGS

FIG. 3 is a part sectional view along line 3—3 of FIG. 2; and

FIG. 4 is a cross sectional view along line 4—4 of FIG. 3.

DESCRIPTION OF THE PREFERRED EMBODIMENT

Figure 1:
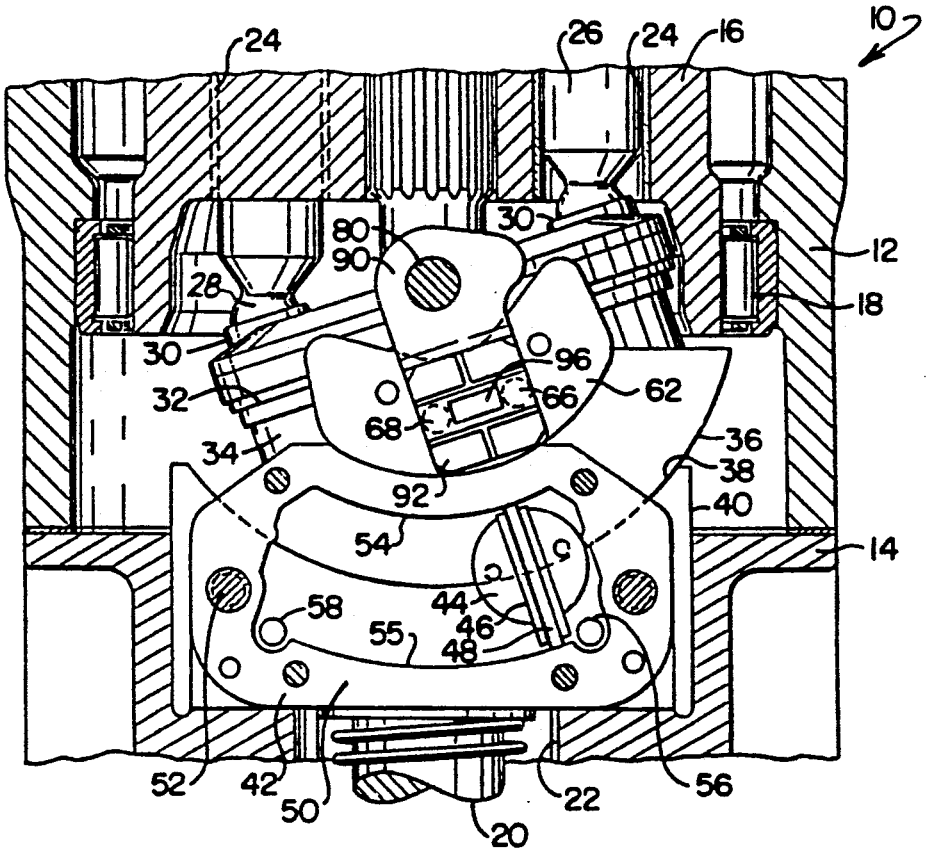
FIG. 1 is a part sectional view of a pump and a portion of the manual rotary servo input control for the pump.

Turning to FIG. 1, a variable displacement axial piston pump (10) having a rocker cam pivotally mounted in a cam support which utilizes the manual rotary servo input control of the present invention may be seen to include a central housing (12), an end cap (14) at one end and a port cap, not shown, at the other end. Bolts connect the end cap (14) to the central housing (12).

Central housing (12) defines a cavity which mounts a rotatable cylinder barrel (16) in a roller bearing (18) pressed into the housing (12). A shaft (20) passes through a bore (22) defined in end cap (14) to drivingly engage the barrel (16).

Barrel (16) has a plurality of bores (24) equally spaced circumferentially about its rotational axis. Each bore (24) contains a piston (26) having a ball shaped head (28). A shoe (30) is swaged onto the head (28) of the piston (26) such that the shoe can pivot about the end of the piston. Each of the shoes is clamped against a flat thrust plate or surface (32) formed on the face of a rocker cam (34) utilizing a conventional shoe retainer assembly of the type described in detail in U.S. Pat. No. 3,904,318 assigned to the predecessor in interest of the subject invention. This patent describes in detail the variable displacement axial piston pump described herein and controlled by the manual rotary servo input control of the subject invention.

Turning again to FIG. 1, rocker cam (34) has an arcuate bearing surface (36) which is received in a complementary arcuate bearing surface (38) formed in a rocker cam support (40). The cam support (40) is fixedly mounted within the pump housing (12). Rocker cam (34) pivots about a fixed axis perpendicular to the axis of rotation of barrel (16) to change the displacement of the pump. In operation, a prime mover, not shown, rotates drive shaft (20) which in turn rotates barrel (16) within housing (12). When the thrust plate (32) on rocker cam (34) is perpendicular to the face or bottom surfaces of the piston shoes (30), rotation of drive shaft (20) will cause the piston shoes to slide across the thrust plate surface (32) but no pumping action will occur inasmuch as the pistons (26) will not reciprocate within the bores (24). In this position thrust plate (32) is perpendicular to the axis of drive shaft (20) and minimum fluid displacement occurs. As rocker cam (34) and thrust plate (32) are inclined from this position, the pistons (26) will reciprocate as the shoes (30) slide over the thrust plate (32). As the pistons (26) move downwardly as shown in the bore (24) to left of the center of the pump low pressure fluid is drawn into the cylinder bores (24). As the pistons move upwardly as shown in the piston bore (24) to the right of the center of the pump they expel high pressure fluid into an exhaust port. Fluid displacement increases as the angle of inclination of the thrust plate (32) increases. In FIG. 1, the rocker cam (34) and thrust plate (32) are shown in a position of maximum fluid displacement in one direction. The rocker cam (34) may be pivoted clockwise such that the intake and exhaust ports are reversed and the device is providing maximum fluid displacement in the opposite direction.

Movement of rocker cam (34) and thrust plate (32) is accomplished by means of a pair of fluid motors (42) one on each side of the rocker cam (34). Only one fluid motor (42) may be seen in FIG. 1. However, a second identical fluid motor sits in the housing (12) on the opposite side of the rocker cam (34) such that equal thrust forces are exerted on each side of the rocker cam to pivot it within the rocker cam support (40).

Although this description will refer solely to the fluid motor (42) shown in FIG. 1, the description applies equally well to the fluid motor on the opposite side of the rocker cam. Fluid motor (42) includes a vane (44) formed integrally with the side of rocker cam (34) so as to be rigidly secured thereto and movable therewith. The vane (44) extends radially beyond bearing surface (36) such that one-half of the area of the vane (44) projects beyond the bearing surface (36). A radial slot (46) in vane (44) houses a seal assembly (48). The vane (44) and seal assembly (48) are received within a vane housing (50) which is rigidly attached to the side of the rocker cam support (40) by a combination of locating pins and bolts (52). Vane housing (50) has an opening defined by a pair of arcuate surfaces (54 and 55) adapted to engage the inner and outer ends of the seal (48). A cover, not shown, seals the end of the vane housing (50) to provide a pair of fluid tight chambers located on opposite sides of the vane (44).

The fluid motor (42) may be operated by supplying pressurized servo control fluid to one of the vane chambers (56 and 58) and simultaneously exhausting fluid from the other chamber (56 and 58) to cause the vane (44) and rocker cam (34) to pivot.

The operation of the fluid motor (42) is controlled by a rotary servo or follow-up input control valve mechanism (60) which regulates the supply of pressurized servo fluid to the vane chambers (56 and 58). This mechanism now will be described. It should be noted that a single control valve mechanism supplies fluid to both of the fluid motors (42). This is made possible inasmuch as the corresponding vane chambers (56 and 58) for both fluid motors are interconnected.

The manual rotary servo control valve mechanism (60) of the present invention includes a valve plate (62) rigidly mounted on a stem (64) which in turn is bolted to rocker cam (34). Valve plate (62) and fluid motor vane (44) move along concentric arcuate paths when rocker cam (34) is moved. Valve plate (62) has a pair of fluid receiving ports (66 and 68) which are connected to the respective vane chambers (58 and 56) of fluid motor (42) through fluid passageways (70 and 72) formed in stem (64) and connecting passages not shown drilled within rocker cam (34).

For counterclockwise operation of fluid motor (42), pressure fluid is supplied to port (66) and flows through passageway (70) of stem (64) and into vane chamber (58) to move vane (44) and rocker cam (34) counterclockwise. Expansion of chamber (58) causes the opposite chamber (56) to contract and exhaust fluid through passageway (72) and out of port (68) into the pump housing. For clockwise operation of the fluid motor, pressure fluid is supplied to port (68) in valve plate (62) and flows through passageway (72) into vane chamber (56). As vane (44) and rocker cam (34) pivot clockwise, pressure fluid is exhausted from vane chamber (58) through passageway (70) and port (66) into the pump casing.

Figure 2:
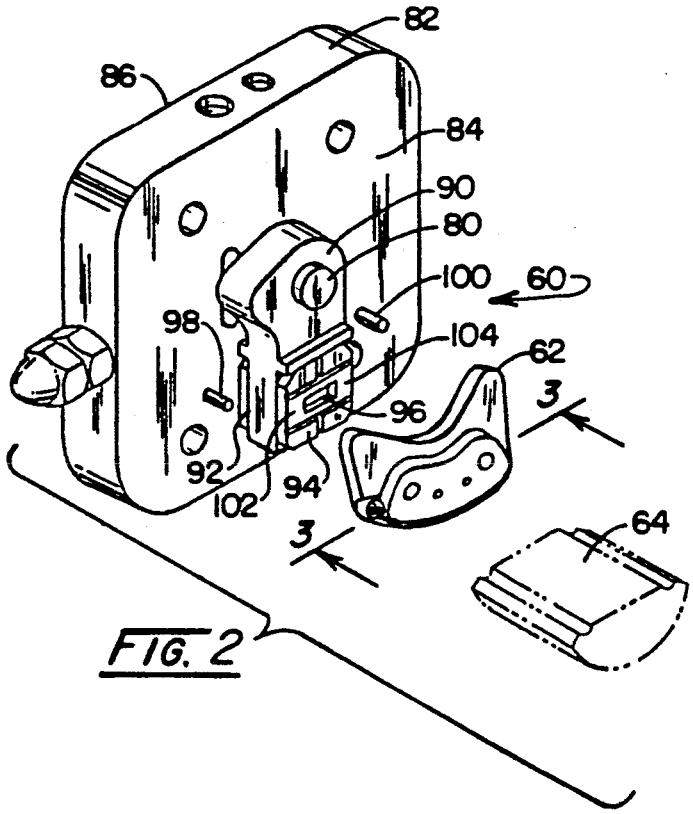
FIG. 2 is a perspective view showing the inner side of a cover plate which overlies the manual displacement control illustrated in FIG. 1.

Turning to FIGS. 1 and 2, that portion of the manual rotary servo control valve (60) which selectively supplies fluid to ports (66 and 68) in valve plate (62) now will be described. A manual input control handle, not shown, is attached to an input shaft (80) which is mounted in a bore in a cover plate (82). FIG. 2 shows the flat inner surface (84) (i.e., the surface that overlies valve plate 62) of cover plate (82). The manual control handle not shown resides on the outer surface (86) of cover plate (82). Cover plate (82) is attached to housing (12) by bolts, not shown.

An arm (90) which overlies the inner surface (84) of cover plate (82) is rigidly connected to input shaft (80). A pair of valve shoes (92 and 94) are mounted in bores formed in the outer end of arm (90). Valve shoes (92 and 94) are mounted for limited pivotal movement within the bores in the outer end of arm (90) and are spring biased outwardly such that valve shoe (92) is spring biased against the inner surface (84) of cover plate (82) and valve shoe (94) is spring biased against the top surface of valve plate (62). Because the valve shoes (92 and 94) may pivot to some degree within the bores in arm (90) the shoes fit tightly against the flat surfaces on the inner surface of cover plate (82) and on valve plate (62) and can accommodate any nonparallelism or misalignment which occurs between the surfaces. Valve shoes (92 and 94) are identical. It should be noted that valve shoe (92) is illustrated in FIG. 1 and the flat portion of that shoe which slides across the inner surface (84) of cover plate (82) is shown facing upwardly in that view. Each shoe (92 and 94) has a central bore (95) which may be seen in FIG. 4 and which opens into a central rectangular port (96). It should be observed that a servo pump, not shown, is driven by the prime mover which rotates drive shaft (20) and provides a source of servo pressure fluid to cover plate (82). This fluid is connected through internal drilled passages not shown to a port which is aligned with the port (96) and the central bore (95) and in shoe (92). Thus, shoe (92) receives servo pressure fluid from cover plate (82) and provides it to the central bore (95) and port (96) in valve shoe (94) which slides across valve plate (62). Port (96) in valve shoe (92) remains in alignment with the servo fluid supply opening in cover plate (82) throughout its entire range of movement. Stop pins (98 and 100) are inserted into the inside surface (84) of cover plate (82) and serve to limit the maximum movement of input arm (90). Since the angular movement of input arm (90) determines the angular displacement of rocker cam (34), the stop pins (98 and 100) also serve to set the maximum displacement positions for the pump (10). These pins also prevent port (96) in shoe (92) from moving out of fluid communication with the servo fluid supply port in cover plate (82).

Operation of the fluid motor (42) by the manual rotary servo input control valve (60) to change the displacement of the pump now will be described. When the fluid motor is idle, fluid port (96) lies between the valve plate ports (66 and 68) as shown in FIG. 1. To change the displacement of the pump (10), the control handle rotates input shaft (80) and input arm (92) in the direction rocker cam (34) is to pivot and to the displacement setting desired for the pump. Thus, if input shaft (80) is rotated clockwise as viewed in FIG. 1, this causes the fluid outlet opening (96) in shoe (94) to overlie port (68) in valve plate (62). This will cause servo pressure fluid to flow to vane chamber (56) to cause vane (44) and rocker cam (34) to pivot clockwise. Rocker cam (34) will rotate clockwise until port (68) in valve plate (62) moves out of alignment with the servo fluid supply port (96) in shoe (94) and port (96) lies between the valve plate ports (66 and 68). It should be remembered that valve plate (62) which carries fluid ports (66 and 68) is rigidly affixed to rocker cam (34) and pivots therewith. Because of this, when rocker cam (34) and valve plate (62) have moved through the same angle as input shaft (80) and input arm (90), the supply port (96) will be centered between the ports (66 and 68) and flats (102 and 104) will overlie these ports. Thus, a follow-up mechanism is provided inasmuch as rocker cam (34) always pivots through the same angle as the input shaft (80) and input arm (90) pivot.

As mentioned above, the flat surfaces (102 and 104) on valve shoe (94) overlie the fluid ports (66 and 68) in valve plate (62) when the displacement of the pump is not changing. However, in some instances the displacement of the pump may be changed independently of the action of the manual rotary servo control valve (60). As an example, an automatic control may direct pressure fluid at greater than servo pressure into one of the vane chambers (56 and 58) to reduce the displacement of the pump when a previously set pressure or flow rate has been exceeded. When this occurs rocker cam (34) pivots and input arm (90) and valve shoes (92 and 94) remain stationary. As a result, the ports (66 and 68) in valve plate (62) are uncovered and a path for leakage of fluid from the vane chambers (56 and 58) has been opened. Previously, in order to reduce the flow of fluid from the vane chambers (56 and 58) under these conditions the fluid passageways (70 and 72) in valve stem (64) have contained a restriction or orifice to limit the outflow. Unfortunately, the orifices also serve to limit the rate of response of the control when the manual rotary servo control valve (60) operates to control the pump (10). The same leakage occurs when an auxiliary device such as an electrically controlled valve has control of the displacement changing mechanism for the pump. When this occurs the ports (66 and 68) again are uncovered and fluid leaks from the vane chambers (56 and 58). Unfortunately, where the auxiliary device such as the electrically controlled valve utilizes servo pressure fluid to change the displacement of the pump, the leakage of fluid from the chambers (56 and 58) from the uncovered port (66 and 68) cannot be tolerated. Because of this, a blocking mechanism (110) has been incorporated into the manual rotary servo control valve (60) to block the flow of fluid from the valve ports (66 and 68) when the manual rotary servo control valve (60) is not operating to change the displacement of the pump. It should be noted that when an auxiliary device utilizing pressure fluid at servo pressure acts to control the displacement of the pump, the flow of servo pressure fluid to the cover plate (82) must be diverted or stopped. Otherwise the auxiliary device will not be able to assume control of the pump from the manual rotary input control valve (60) as that device also will supply pressure fluid at servo pressure when the rocker can has been rotated such that port (96) in shoe (94) overlies one of the valve plate ports (66 and 68). An electrically controlled or a hydraulically controlled valve may be utilized to divert or interrupt the supply of servo pressure fluid to cover plate (82).

Referring to FIGS. 3 and 4, a blocking mechanism (110) has been incorporated into valve plate (62) to prevent the flow of fluid from vane chambers (56 and 58) through valve plate ports (66 and 68) whenever the manual rotary servo control valve (60) is in the centered position and is not acting to change the displacement of the pump. A lateral bore (112) is formed in valve plate (62). This bore intersects a pair of inner orifices (114 and 116) which open into fluid passages (70 and 72) leading to the vane chambers (56 and 58). The orifices (114 and 116) are in fluid communication with the valve plate ports (66 and 68) through lateral bore (112). Lateral bore (112) contains a movable shuttle (118) having an outer surface which substantially seals against the inner wall of the bore. In other words, fluid on one side of shuttle (118) substantially is prevented from flowing to the other side. Pistons (120 and 122) are located in bore (112) on opposite sides of shuttle (118). Pins (124 and 126) project into bore (112) and limit the lateral movement of the pistons (120 and 122) respectively. Springs (128 and 130) received within bores in pistons (120 and 122) respectively serve to bias the pistons towards the stops (124 and 126).

FIG. 4 illustrates the position of the blocking mechanism (110) when the manual rotary servo control valve (60) is inactive. When this occurs springs (128 and 130) move the pistons (120 and 122) to the extreme inward positions limited by the pins (124 and 126). In this position the pistons (120 and 122) overlie the orifices (114 and 116) to thereby seal passages (70 and 72) which connect to the vane chambers (56 and 58) as explained above.

Thus, no servo fluid can flow out of the ports (66 and 68) in the valve plate (62) despite the fact that pressure fluid is supplied to the vane chambers (56 and 58) to change the displacement of the pump and the valve plate (62) is moved with respect to valve shoe (94) to cause the ports (66 and 68) to become uncovered.

Turning to FIG. 4, it may be seen that the ports (66 and 68) open into somewhat smaller passages (138 and 140) respectively which in turn open into lateral bore (112). It should be observed that when the blocking mechanism (110) has moved the pistons (120 and 122) to a position blocking orifices (114 and 116) the fluid passages (138 and 140) are not completely blocked. A very small opening remains between the inner ends of the pistons (120 and 122) and the edge of the bores (138 and 140). This underlap of the pistons (120 and 122) with respect to the bores (138 and 140) is necessary to move the blocking mechanism (110) to unblock the orifices (114 and 116). This occurs as follows. When the input shaft (80) and arm (90) are rotated to change the displacement of the pump such that the central port (96) is moved from a position between the valve plate ports (66 and 68) to a position in which it overlies one of the valve plate ports (66 and 68) servo pressure fluid will be supplied to that port. Assuming that the valve shoe (94) has been moved to the left such that port (96) overlies valve plate port (68), pressure fluid will flow through passage (138) and pass the inner end of piston (120). This fluid will enter the space between shuttle (118) and piston (120) to simultaneously cause the shuttle (118) to move to the right and cause piston (122) to move to the right and unblock fluid passage (116) and also cause piston (120) to move to the left and unblock fluid passage (114). Of course, the servo pressure fluid must have sufficient force to overcome the force of the springs (128 and 130). When the rocker cam (34) has pivoted to assume the new position set by the manual rotary servo control valve (60) and valve plate (62) has rotated to a position where the central port (96) and shoe (94) lies between the valve plate ports (66 and 68) fluid flow to the port (68) will be cutoff and blocking mechanism (110) will again function to seal the fluid passageways (114 and 116). Of course, if the manual rotary servo control valve (60) is operated such that input shaft (80) and input arm (90) are rotated to move the valve shoe (94) to the right as viewed in FIG. 4, servo pressure fluid will flow through port (66) into the space between the end of piston (122) and shuttle (118) to force shuttle (118) to move to the left and in turn move piston (120) to the left to uncover fluid passage (114) and simultaneously move piston (122) to the right to uncover fluid passage (116).

From the above, it may be seen that the instant invention provides a manual rotary servo control valve having a blocking mechanism which functions to block the ports (66 and 68) in valve plate (62) when the manual rotary servo control valve (60) is not acting to change the displacement of the pump.

Since certain changes may be made to the above-described structure and method without departing from the scope of the invention herein it is intended that all matter contained in the description thereof or shown in the accompanying drawings shall be interpreted as illustrative and not in a limiting sense.

We claim:

1. A control for a variable displacement axial piston pump having a housing, a rocker cam pivotably mounted in a cam support within said housing for changing the displacement of the pump, a servo fluid motor for pivoting the cam between a position of maximum fluid displacement in one direction and a position of maximum fluid displacement in the other direction with a centered position of minimum fluid displacement therebetween including a first fluid motor member attached to the rocker cam and a second fluid motor member cooperative with the first fluid motor member to define first and second sealed fluid receiving chambers, a source of servo pressure fluid, a rotary servo control valve for supplying servo pressure fluid to one of said first and second sealed fluid receiving chambers to selectively operate said fluid motor to move the rocker cam to a position set by the control valve including a movable control arm, a flat valve plate having first and second fluid receiving ports secured to and movable with said rocker cam, first and second passage means connecting said first and second fluid receiving ports to said first and second fluid receiving chambers respectively, a valve shoe carried by said control arm and having a flat face slideable on said flat valve plate, said valve shoe having a fluid supply port in said face connected to said servo pressure fluid source and movable by said control arm between positions overlying one or the other of said first and second fluid receiving ports and a centered position between said first and second fluid receiving ports the improvement comprising: blocking means for blocking fluid flow located in said valve plate between said first and second fluid receiving chambers and said first and second fluid receiving ports to enable said blocking means to move with said rocker cam relative to said valve shoe, wherein said blocking means includes a piston bore which intersects said first and second passage means, a shuttle having a sealing land which seals said piston bore and is slideable in said piston bore, a first piston slideable in said piston bore on one side of said shuttle, a second piston slideable in said piston bore on the other side of said shuttle, a first stop for positioning said first piston in said piston bore such that said piston blocks said first passage means, a second stop for positioning said second piston in said piston bore such that said second piston blocks said second passage means, first biasing means for biasing said first piston towards said first stop and second biasing means for biasing said second piston towards said second stop.

* * * * *